US005918878A

United States Patent [19]

Coyette

[11] Patent Number: 5,918,878

[45] **Date of Patent: *Jul. 6, 1999**

[54] MACHINE FOR FINISHING PRINTED SHEETS

[75] Inventor: Luc Coyette, Cortil Noirmont, Belgium

[73] Assignee: C.P. Bourg S.A., Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/788,563

[22] Filed: Jan. 24, 1997

Related U.S. Application Data

[62] Division of application No. 08/351,644, Dec. 7, 1994, Pat. No. 5,632,587.

[30] Foreign Application Priority Data

Apr. 15, 1994 [FR] France ..... 94 04544

[51] Int. Cl.[6] ..... B65H 5/34

[52] U.S. Cl. ..... 271/270; 271/176; 271/203

[58] Field of Search ..... 271/182, 176, 271/270, 203

[56] References Cited

U.S. PATENT DOCUMENTS

| | | | |
|---|---|---|---|
| 4,693,461 | 9/1987 | Takahashi | 271/182 X |
| 4,696,463 | 9/1987 | Nakazoto et al. | 271/182 X |
| 4,995,859 | 2/1991 | Totani | 271/182 X |

*Primary Examiner*—David H. Bollinger
*Attorney, Agent, or Firm*—Sixbey, Friedman, Leedom & Ferguson, P.C.; Gerald J. Ferguson, Jr.; Tim L. Brackett, Jr.

[57] ABSTRACT

A finishing machine is proposed for printed sheets delivered individually in rapid succession by a reproduction machine such as a printing press or a copier. The machine renders possible the manufacture in a production line in a completely automatic manner of brochures, leaflets or booklets without trimming edges. The machine comprises as its main part a station for takeover of the delivered sheets; a device for controlled retardation of the sheets received from the takeover station; a station for horizontal stacking of the retarded stacks; a mechanism for the alignment of the stacked sheets; a device for gripping the stack of aligned sheets a device for pivoting of the gripped stack from a horizontal position to an on-edge position; and a device for encasing the stack in a cover.

3 Claims, 5 Drawing Sheets

MACHINE FOR FINISHING PRINTED SHEETS

This is a Divisional application of Ser. No. 08/351,644, filed Dec. 7, 1994, now U.S. Pat. No. 5,632,587.

The invention relates to a machine for finishing printed sheets supplied individually and in rapid succession by a reproduction machine, such as a printing press or copying machine and for processing such sheets in the form of a brochure, leaflet or booklet.

Modern printing presses are capable of producing images on sheets at extremely high rates of up to more than one hundred pages per minute and even more. Instead of always reproducing the same page in a working cycle, as is the case with copying machines or offset litho presses, such machines successively produce complete sets of pages of a work, which are then frequently to be converted into a brochure, leaflet or booklet.

For processing stacks of sheets to make a brochure, leaflet or booklet finishing machines are certainly available. When it is desired to present the brochure, leaflet or booklet in a cover, such finishing machines comprise a gluing and encasing station in which a stack of sheets is firstly glued on a stack edge by passage past a rotating roll dipping into a liquid glue and the cover is then applied to the glue covered edge of the stack and folded around the same. Having regard to the irregularity of the sheets presenting themselves in a stack and in order to ensure that the edges of the finished product are neatly aligned, it is then necessary to trim the edges of the stack sheets in the cover. The resulting product therefore does not have the same dimensions as the sheets leaving the reproducing machine, as for instance DIN A 4. Moreover, the stacks of sheets are manually loaded on the finishing machine, something which depends not only on a previous alignment into stacks of sets of sheets emerging from the reproducing machine, but furthermore on human intervention for moving each assembled stack to the finishing machine.

The finishing machine in accordance with the invention obviates all these drawbacks. In accordance with the invention such finishing machine comprises in succession: a takeover station for the sheets supplied by the reproducing machine; a device for the controlled retardation of the sheets received from the takeover station; a station for producing a horizontal stack of the retarded sheets; means for alignment of the stacked sheets; a gripping device for the stack of aligned sheets; a device for pivoting the gripped stack from a level position to a position on edge; and a device for gluing an edge of the stack and/or encasing of the stack in a cover. Using such combination of means, which may be of known design, it is possible to set up a continuous, completely automatic production line extending from the reproducing machine as far as a terminal station, which may be a collect station for the finished product. Taking into account the speed with which the sheets come off the reproducing machine, of for example 1 meter per second or more, it will be seen that the result is quite impressive. In effect, at such a speed of advance, the sheets will be conveyed in a practically random fashion unless same are subjected to a positive guiding effect. Thus in order to stack the sheets ejected in this manner, it is firstly necessary to retard same. In order to stack the sheets satisfactorily permitting correct alignment in the stack, the invention provides for controlled retardation of the sheets. The term "controlled retardation" employed herein means deceleration which is practically identical for each sheet from an initial speed down to a given reduced speed, making it possible for the sheets to be correctly superposed in a stack in such a manner that it is then sufficient to employ simple means to align the sheet in the stack. Since the invention then provides for the use of a stack gripping device for the aligned sheets, even during the pivoting of the stack out of a horizontal position into an on-edge position, the correct alignment of the sheet in the stack is maintained. Taken together such measures firstly render it possible to establish the correct alignment of the sheets in the stack as far as the encasing station, something rendering unnecessary any cutting operation in order to ensure alignment of the sheets in the final product.

In a preferred embodiment alignment of the sheets of the stack is not only provided for during the formation thereof but also after pivoting thereof into the on-edge position. In fact on transfer from the stacking station to the pivoting device for the stack, the alignment of the sheets may be lost to a certain extent. Furthermore when the stack of sheets is on edge, gravity may be utilized to improve accuracy of alignment. In either case alignment is preferably effected in two directions, that is to say in the direction of forward motion and in a direction perpendicular thereto.

In accordance with one significant aspect of the invention there is the provision of a retarding device for sheets received individually and in rapid succession with a view to stacking them, that is to say more particularly but not exclusively in a finishing machine of the type described hereinbefore. This device comprises at least one pair of rolls between which each sheet is engaged as from the reception thereof; one of the rolls is driven by a motor at a controlled speed and more particularly by a stepper motor controlled in such a manner that the speed of rotation of the rolls corresponds to the speed of supply of the sheets at the time of their engagement between the rolls and is reduced to a fraction of such speed at the moment at which the sheet is released by the rolls. Preferably the stepper motor rotates at a reduced speed while waiting for a sheet and is accelerated as soon as the arrival of a sheet is detected. In such a case a sheet detector is arranged on the input side of the rolls at a certain distance therefrom and is started when the leading edge of a sheet is detected by the detector, and the sheet retarding phase is started as soon as the passage of the trailing edge thereof is detected by the detector. Owing to this design the stepper motor is not operated in the wait mode and the control of the stepper motor is substantially facilitated because the retardation of the sheet is always started by the passage of the trailing edge thereof at the detector, such control therefore being independent of the length of the sheet.

In order to improve the accuracy of alignment of the cover in relation to the sheets in the stack the invention furthermore contemplates the provision of a precise metering of the quantity of glue utilized for each brochure, leaflet or booklet. Specifically the invention suggests an arrangement such that the encasing station comprises a rotating glue fountain roll dipping into liquid glue and a doctor selectively moved between a retracted position and an engagement position for engagement of the surface of the fountain roll in order to accumulate a mass of glue, which is presented to the edge of a stack when same moves on edge over the rotating fountain roll. The metering (rate of application) of the mass of glue is set by control of the doctor as function of the movement of the stack and the thickness thereof.

Other details and features of the invention will become apparent from the following description and the accompanying drawing.

Figure 1:
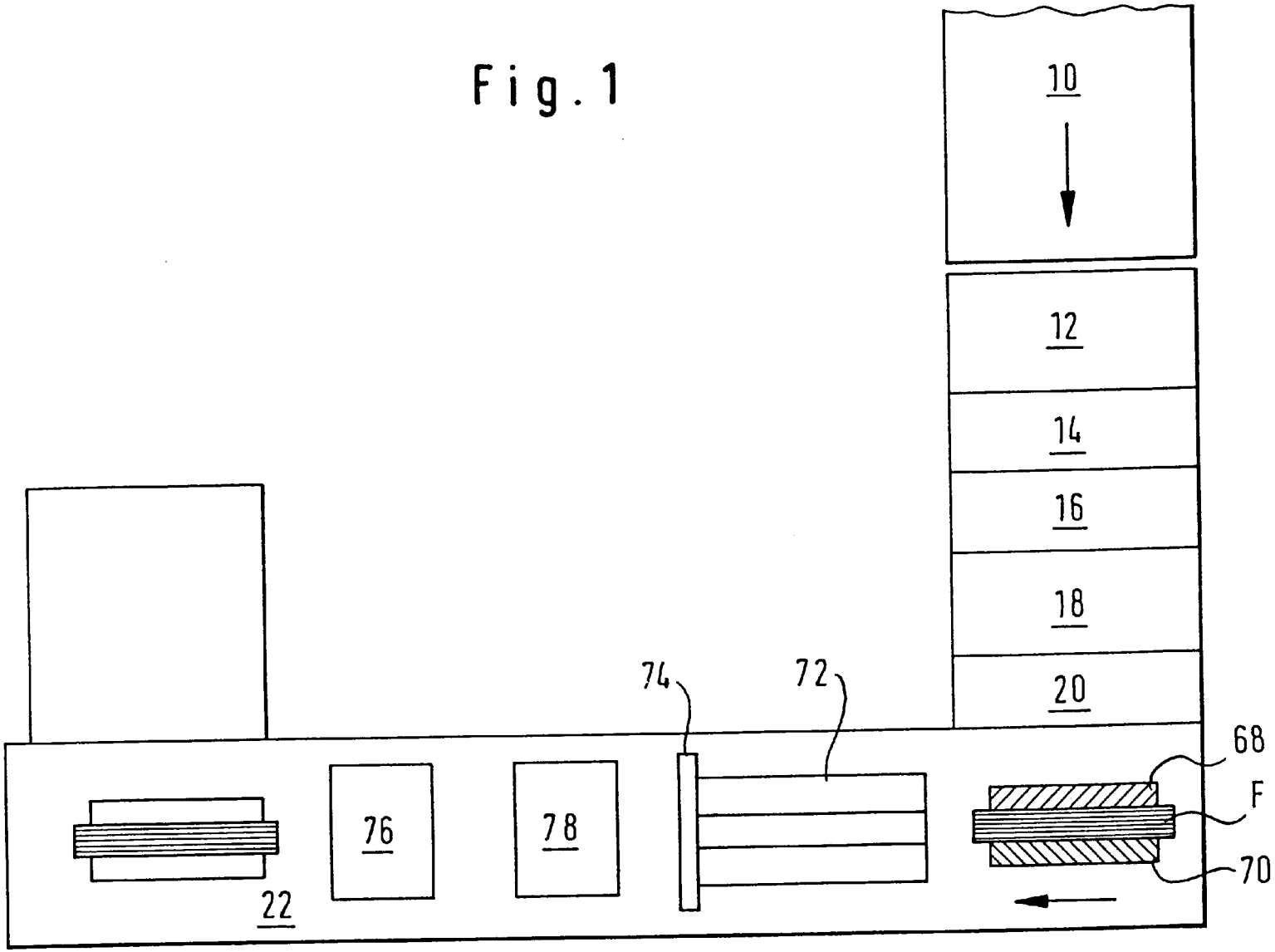
FIG. 1 is a diagrammatic plan view of one possible embodiment of the finishing machine.
Figure 2:
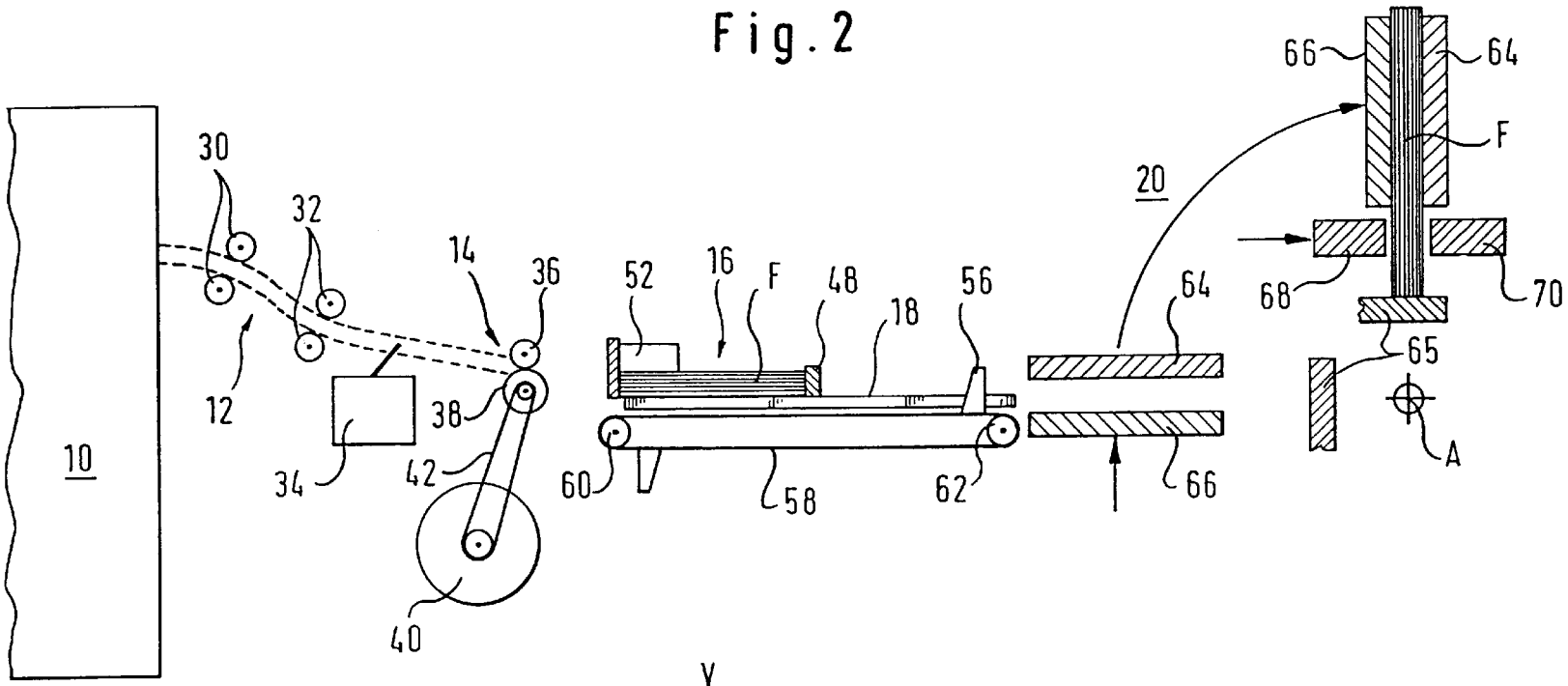
FIG. 2 is a diagrammatic elevation of one station for taking over the sheets, of a controlled retarding device for the sheets, a stacking station and a device for the pivoting of a stack of sheets.
Figure 2A:
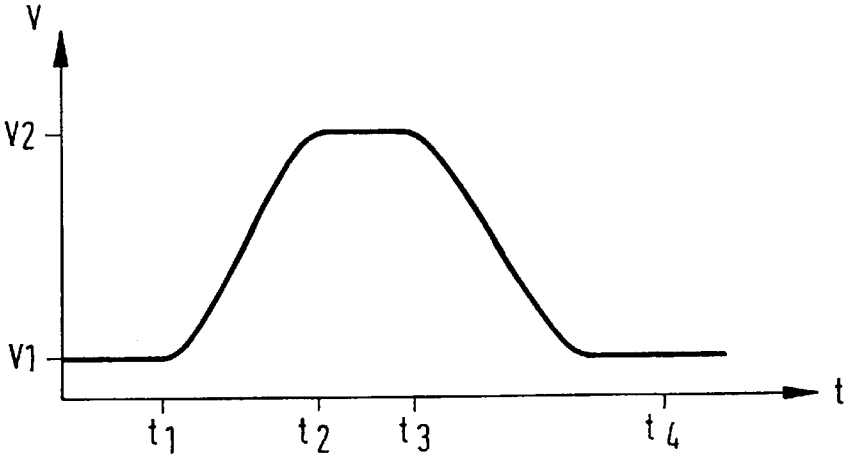

FIG. 2*a* is a diagram illustrating the retarding function.

Figure 3:
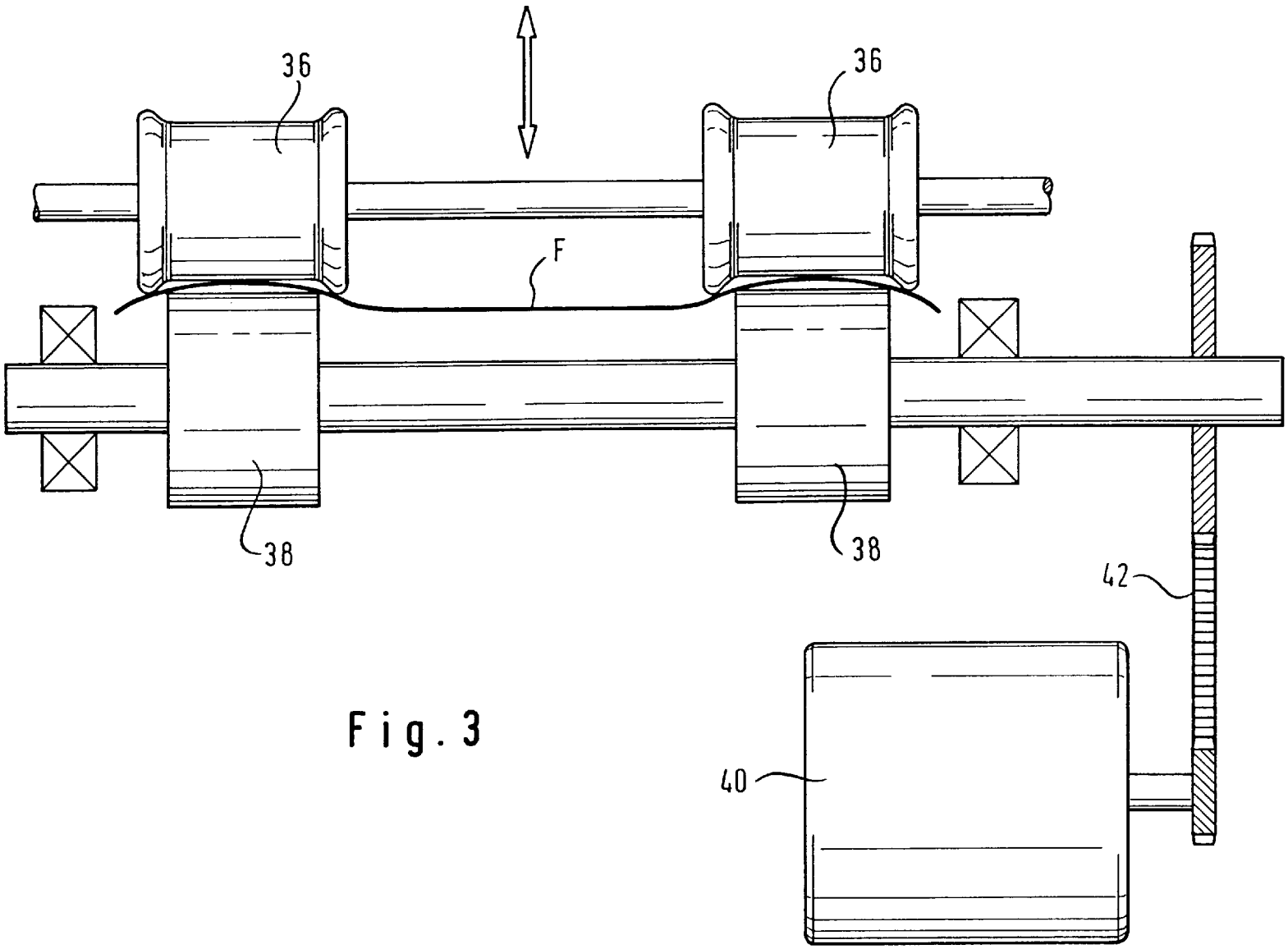

FIG. 3 is a diagrammatic view of a part of the retarding device.

Figure 4:
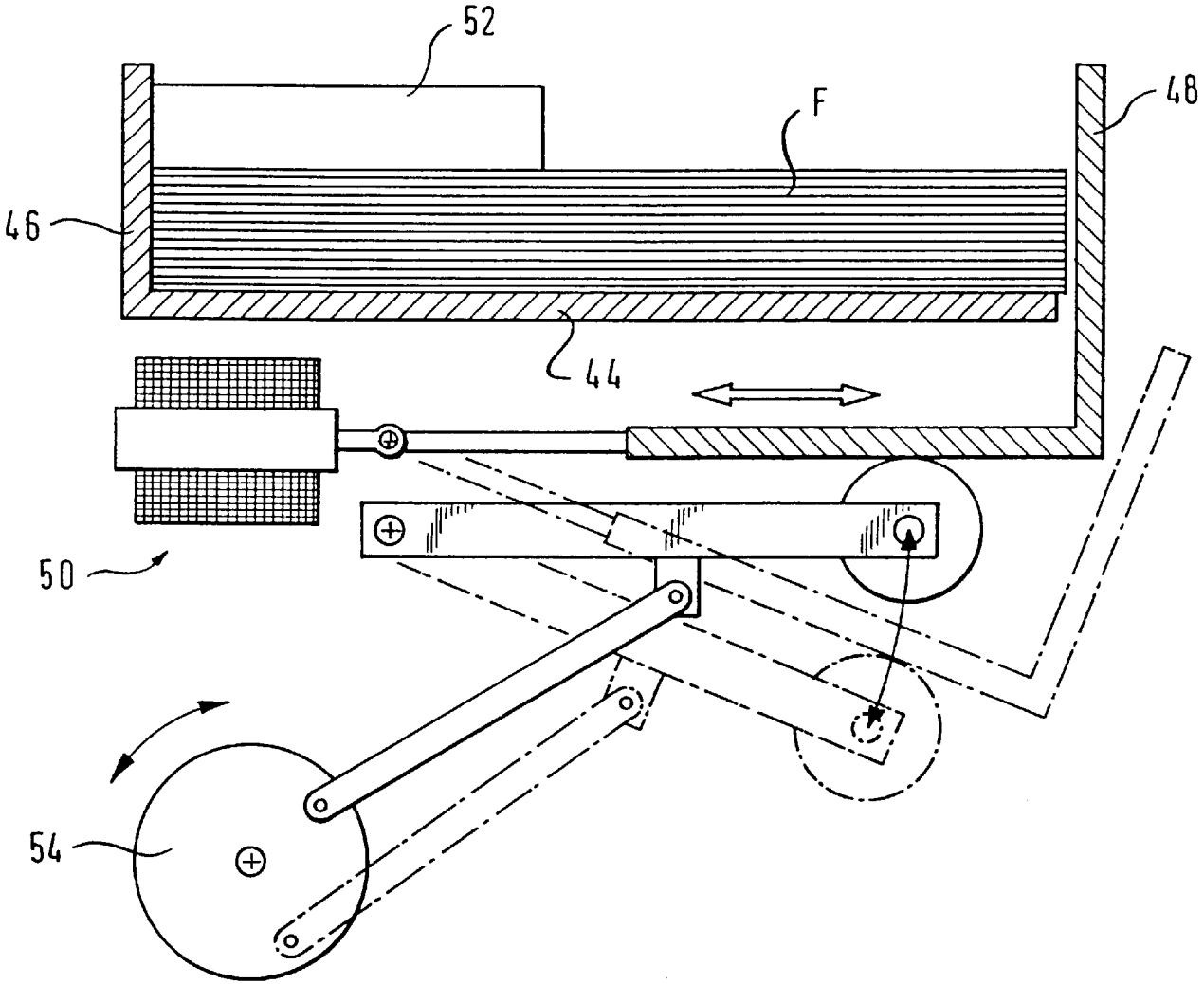

FIG. 4 is a view of part of the sheet alignment device in a stack.

Figure 5:
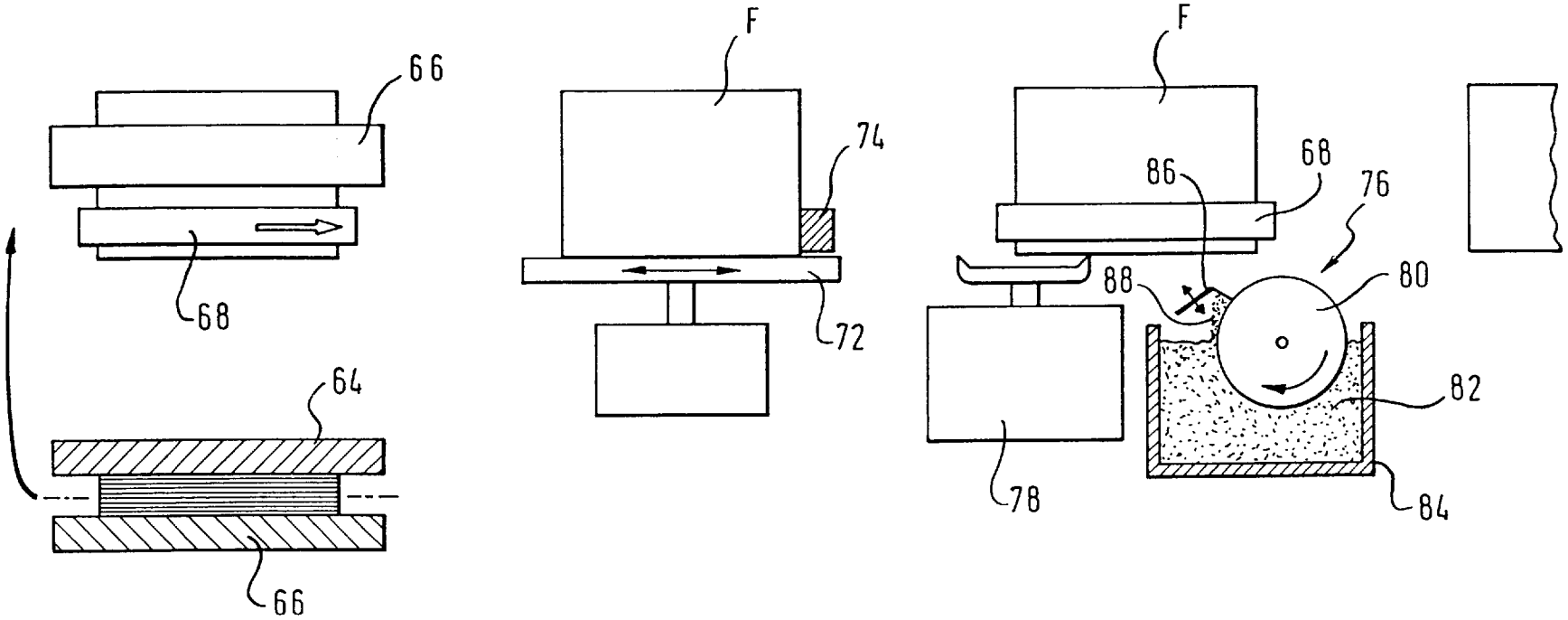

FIG. 5 is a diagrammatic view of the stack pivoting device, of a vibratory stack alignment device and of a gluing device preceding an encasing station of the machine.

Figure 6:
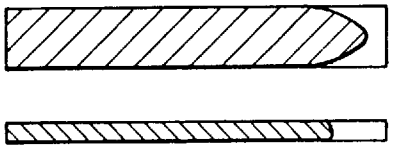

FIG. 6 diagrammatically represents glued stack edge of two sheet stacks with a different thickness.

In the embodiment described herein the finishing machine in accordance with the invention is placed adjacent to a printing press 10 of known type and capable of an output of more than one hundred pages per minute. The printed pages leave the machine at a speed in excess of 1 meter per second. The first station of the finishing machine is a station 12 for taking over the sheets delivered by the printing press 10. Said station 12 is followed by a device 14 for retarding the sheets received by the station 12. After controlled retardation of the sheets by said device 14, the sheets are stacked horizontally in a stacking station 16. Each stack of sheets is then moved by a transfer table 18 to a pivoting device 20, which delivers each stack of sheets on edge, after pivoting through an angle of 90° around a horizontal axis, to an encasing station 22, orientated perpendicularly to the alignment of the printing press 10 and the units 12 through 20 of the finishing machine. This encasing station will be described in more detail during the course of the further description herein.

As will appear more clearly from FIG. 2, the station 12 for taking over the sheets delivered by the printing press 10 comprises several pairs of conveying rolls 30 and 32, which turn at a speed substantially equal to the speed of the speed of supply of the sheets received from the printing press 10. At the output part of this station 12, a detector 34 detects the passage of each sheet. To be more precise, said detector 34 supplies a first signal on detecting the leading edge of a sheet and a second signal on detection of the trailing edge of a sheet. The sheets then pass into the device 14 for controlled retardation. This device is essentially made up of two pairs of rolls 36 and 38, of which one, 38, is caused to rotate by a stepper motor 40 via a gear belt 42. As shown in the graph of FIG. 2*a* the stepper motor 40 drives the rolls 38 normally at a low speed v1 in a sheet wait or standby mode. When at the instant t1 the detector 34 detects the passage of the leading edge of a sheet the motor 40 is accelerated to drive the rolls 38 at a substantially greater speed v2 essentially equal to the speed of supply of the sheets. In the graph of FIG. 2*a* this speed v2 is reached at the instant t2. The leading edge of the sheet is engaged between the rolls 36 and 38 and the sheet is supplied at the speed v2 until the instant t3, where passage of the trailing edge of the sheet is detected by the detector 34. This event triggers a controlled retardation of the stepper motor 40 until the rolls 38 will be turning at a reduced speed v1. This speed v1 is sufficiently low to ensure that the sheets, when they are released by the rolls 36 and 38 at the instant t4, will correctly drop in free fall into the stacking station 16.

As shown in FIG. 3 the rolls 36 are shaped so as to cause a slight deformation of the sheet F and therefore to increase the stiffness thereof as it goes on its way in the retarding device to the stacking station. This action is generally termed tiling.

In the stacking station 16 represented in detail in FIG. 4 the sheets F are stacked on a board 44 provided with a fixed rear abutment 46 and associated with a front tapping abutment 48, operated by an electromagnet 50, in order to align the sheets F against the abutment 46 by a movement tapping the same toward such abutment. Simultaneously, the sheets F are aligned by a lateral tapping abutment 52, also operated by an electromagnet (not illustrated). As shown in FIG. 4 as well, the front tapping abutment 48 is retractable in order to permit the forward movement of the stack of sheets F when such stack is complete. The retraction of the front tapping abutment 48 is caused by a crank mechanism using a motor 54 with reduction gearing.

The transfer table 18 is provided with two longitudinal parallel slots to permit the passage of entrainment dogs 56 secured on an endless belt 58. The endless belt 58 is driven about two bend rolls 60 and 62 placed below the transfer table 18. In order to advance a completed stack in the stacking station 16, one of the rolls 60 and 62 is driven for rotation in order to move the dogs 56 against the rear edge of the stack of sheets F and to push same and toward the rotation device 20 toward the front abutment 65. The stack of sheets F consequently slides on the transfer table 18 as far as the front abutment 65.

The pivoting device 20 comprises a pair of jaws 64 and 66 adapted to engage and grip such a stack of sheets F (received from the stacking station 16) between them. The jaws 64 and 66 are mounted as single pivoting unit with a horizontal axis A of pivoting perpendicular to the direction of supply of the stack of sheets. As shown in FIG. 2 diagrammatically, the pivoting device 20 turns each stack of sheets F through an angle of 90° so as to place same in the on-edge position. In this position, the stack of sheets F is transferred to the encasing station 22, where the stack of sheets F is taken over by a second pair of jaws 68 and 70. After engagement by the jaws 68 and 70, the jaws 64 and 66 may be released in order to permit the forward movement of the stack of sheets F in a direction perpendicular to the direction of supply on the units 12 through 20 of the machine. For this purpose the jaws 68 and 70 are mounted on a moving carriage of the encasing station. These elements are known as such so that they are not described or represented in detail.

The stack of sheets F is then moved forward by a vibrating table 72, where the jaws 60 and 70 are temporarily released. The vibrating table 72 is associated with a front abutment 74 integral with the jaw 70 which is fixed on the transfer carriage, said abutment 74 permitting a correction of front alignment on the sheets. Then the sheets of the stack will be resting on edge on the vibrating table 72, the alignment thereof being assisted by gravity.

After renewed alignment of the sheets F of the stack on the vibrating table 72 the stack is moved forward, still standing on edge, to a gluing station 76, it moving past a routing unit 78 which works upon the lower edge of the stack of sheets F in order to facilitate the take up of glue thereby. In a familiar fashion the gluing station 76 comprises a turning fountain roll 80 dipping into liquid glue 82 held in a trough 84. A moving doctor 86 is associated with the peripheral surface of the roll 80 in an inherently known manner. However, in accordance with a feature of the invention the movements of the doctor 86 are performed in a very precise manner to ensure correct metering of the quantity of glue to be applied to the edge of the stack of sheets F when it moves past the turning fountain roll 80. Since the glue affects the volume of the spine of a brochure, leaflet or booklet with a cover, the quantity thereof will have a substantial influence on the alignment of the cover in relation to the sheets of the stack after the encasement thereof in the cover.

When the edge of the doctor 86 is retracted from the periphery of the turning roll 80, the glue will constitute a thin layer having a constant thickness on the periphery of the roll, but on the contrary, when the edge of the doctor 86 is in engagement with the periphery of the roll 80, the glue will accumulate at 88 in front of the doctor and is kept from forming a layer on the periphery of the roll. When the doctor 86 is retracted again, the glue 88 will again form a layer on the periphery of the roll 80. The quantity of applied glue on the edge of the stack of sheets F as same moves over the roll 80 is therefore set by the duration of retraction of the doctor 86. The duration of retraction of the doctor 86 is more particularly set as a function of the thickness of the stack of sheets. As regards setting the instant the which the doctor 86 is brought into engagement, same is set by the very movement of the stack when it is moved by the moving carriage of the station, still gripped by the jaws 68 and 70.

The result of the metering of the glue is illustrated in FIG. 6. The reader will see that the glue, indicated by shading on the edge of the stack, is sparingly applied. It leaves one end of the stack edge free, taking into account that after the putting into place of the cover, the glue will be spread out to cover such zone.

After encasing of the stack stuck in a cover and pressing the back of the brochure, leaflet or booklet by another pair of jaws, the operations on the product will have been completed. Since the correct alignment of the sheets is kept as far as the encasing station, no trimming operation by cutting is required.

The operation of encasement being known as such, it will not be described in detail.

What is claimed is:

1. A device for controlled deceleration of sheets received individually at a rapid rate, comprising at least one pair of rolls wherebetween each received sheet is engaged and a variable speed motor means for driving said rolls at a predetermined low idle speed prior to arrival of each sheet at said rolls, driving said rolls at a high speed corresponding to a sheet arrival speed at a moment of arrival of each sheet at said rolls, driving said rolls at said predetermined low idle speed equal to a fraction of said high speed at a moment prior to disengagement of each sheet from said rolls.

2. The device of claim 1 comprising a sheet detector upstream from said rolls, wherein passage of a leading edge of each sheet at said sheet detector causes said rolls to be accelerated from said predetermined low idle speed to said high speed corresponding to the sheet arrival speed, and passage of a trailing edge of each sheet at said sheet detector causes said rolls to be decelerated from said high speed corresponding to the sheet arrival speed to the predetermined low idle speed.

3. The device of claim 1 wherein said variable speed motor is a stepper motor.

* * * * *